US007559779B1

(12) United States Patent
Caines et al.

(10) Patent No.: US 7,559,779 B1
(45) Date of Patent: Jul. 14, 2009

(54) ELECTRICAL CONNECTOR

(75) Inventors: Arturo Caines, Hanover Park, IL (US); Andrew K. Eckhart, Hoffman Estates, IL (US); Vaughn E. Rice, Round Lake Beach, IL (US); Gary L. Tomczak, Yorkville, IL (US)

(73) Assignee: Cinch Connectors, Inc., Lombard, IL (US)

( * ) Notice: Subject to any disclaimer, the term of this patent is extended or adjusted under 35 U.S.C. 154(b) by 0 days.

(21) Appl. No.: 12/152,309

(22) Filed: May 14, 2008

(51) Int. Cl.
*H01R 13/62* (2006.01)

(52) U.S. Cl. ..... 439/157; 439/372

(58) Field of Classification Search ..... 439/157, 439/372, 310, 341, 347
See application file for complete search history.

(56) References Cited

U.S. PATENT DOCUMENTS

| | | | |
|---|---|---|---|
| 2,563,761 | A | 8/1951 | Uline |
| 2,757,349 | A | 7/1956 | Erbal |
| 2,863,131 | A | 12/1958 | Carlzen et al. |
| 3,047,832 | A | 7/1962 | Deakin |
| 3,081,528 | A | 3/1963 | Hanna |
| 3,083,351 | A | 3/1963 | Nielsen, Jr. |
| 3,099,510 | A | 7/1963 | Piorunneck |
| 3,124,407 | A | 3/1964 | Lazar et al. |
| 3,145,069 | A | 8/1964 | Damon et al. |
| 3,181,112 | A | 4/1965 | Bonhomme |
| 3,320,572 | A | 5/1967 | Schwartz |
| 3,345,604 | A | 10/1967 | Henschen et al. |
| 3,381,261 | A | 4/1968 | Deakin |
| 3,396,364 | A | 8/1968 | Bonhomme |
| 3,641,483 | A | 2/1972 | Bonhomme |
| 3,786,558 | A | 1/1974 | McCarthy |
| 3,893,743 | A | 7/1975 | Wallo |
| 4,010,993 | A | 3/1977 | Hohenberger et al. |
| 4,329,008 | A | 5/1982 | Braginetz |
| 4,447,109 | A | 5/1984 | Hobart, Jr. |
| 4,466,684 | A | 8/1984 | Grant et al. |
| 4,564,258 | A | 1/1986 | Garretson et al. |
| 4,655,522 | A | 4/1987 | Beck, Jr. et al. |
| 4,687,278 | A | 8/1987 | Grabbe et al. |
| 4,720,157 | A | 1/1988 | Nestor et al. |
| 4,720,277 | A | 1/1988 | Sakamoto |
| 4,721,484 | A | 1/1988 | Sakamoto et al. |
| 4,722,704 | A | 2/1988 | VanDerStuyf et al. |
| 4,840,587 | A | 6/1989 | Lancella |
| 4,874,338 | A | 10/1989 | Bakermans |
| 5,035,634 | A | 7/1991 | Hasircoglu et al. |
| 5,055,055 | A | 10/1991 | Bakker |
| 5,083,927 | A | 1/1992 | Herard et al. |
| 5,135,410 | A | 8/1992 | Kawase et al. |
| 5,230,635 | A | 7/1993 | Takenouchi et al. |
| 5,256,088 | A | 10/1993 | Lu et al. |

(Continued)

*Primary Examiner*—Khiem Nguyen
(74) *Attorney, Agent, or Firm*—Leydig, Voit & Mayer, Ltd.

(57) ABSTRACT

The electrical connector may include a shroud and a harness connector. The harness connector is disposed within the shroud. The harness connector may include at least one aperture. The electrical connector may include at least one electrical contact disposed in the at least one aperture. The electrical connector may include a cam arm operatively engaged with the harness connector wherein pivoting of the cam arm will move the harness connector with respect to the shroud. The cam arm may pivot between an upper position wherein the harness connector is fully raised within the shroud and a lower position wherein the harness connector is fully lowered in the shroud.

18 Claims, 19 Drawing Sheets

U.S. PATENT DOCUMENTS

| | | | |
|---|---|---|---|
| 5,320,544 | A | 6/1994 | Naoto et al. |
| 5,322,383 | A | 6/1994 | Saito et al. |
| 5,326,288 | A | 7/1994 | Lu et al. |
| 5,340,337 | A | 8/1994 | Pentz |
| 5,401,179 | A | 3/1995 | Shinchi et al. |
| 5,443,393 | A | 8/1995 | Okumura et al. |
| 5,641,293 | A | 6/1997 | Tsuji et al. |
| 5,653,615 | A | 8/1997 | Inaba et al. |
| 5,667,413 | A | 9/1997 | Trafton |
| 5,709,560 | A | 1/1998 | Hio |
| 5,716,232 | A | 2/1998 | Endo et al. |
| 5,741,162 | A | 4/1998 | Kourimsky et al. |
| 5,790,373 | A | 8/1998 | Kim et al. |
| 5,807,120 | A | 9/1998 | Matthews |
| 5,820,423 | A | 10/1998 | Hsu |
| 5,857,877 | A | 1/1999 | Hotea et al. |
| 5,888,081 | A | 3/1999 | Konoya et al. |
| 5,898,993 | A | 5/1999 | Inaba et al. |
| 5,921,822 | A | 7/1999 | Kennedy et al. |
| 5,924,880 | A | 7/1999 | Watanabe et al. |
| 5,938,458 | A | 8/1999 | Krehbiel et al. |
| 5,951,336 | A | 9/1999 | Seko et al. |
| 5,975,928 | A | 11/1999 | Tsuji |
| 5,997,363 | A | 12/1999 | Joly |
| 6,056,570 | A | 5/2000 | Maejima |
| 6,146,161 | A | 11/2000 | Osawa |
| 6,149,473 | A | 11/2000 | Lalange et al. |
| 6,183,282 | B1 | 2/2001 | Okabe |
| 6,193,531 | B1 | 2/2001 | Ito et al. |
| 6,203,340 | B1 | 3/2001 | Yamashita et al. |
| 6,264,485 | B1 | 7/2001 | Saka et al. |
| 6,293,813 | B1 | 9/2001 | Johnston et al. |
| 6,319,050 | B1 | 11/2001 | Miyazaki et al. |
| 6,354,852 | B2 | 3/2002 | Noro et al. |
| 6,358,104 | B2 | 3/2002 | Daugherty et al. |
| 6,361,356 | B1 | 3/2002 | Heberlein et al. |
| 6,413,105 | B2 | 7/2002 | Noro et al. |
| 6,431,922 | B1 | 8/2002 | Ko |
| 6,439,902 | B1 | 8/2002 | Cole et al. |
| 6,471,527 | B2 | 10/2002 | Fukamachi et al. |
| 6,488,516 | B2 | 12/2002 | Osawa et al. |
| 6,517,364 | B2 | 2/2003 | Muramatsu et al. |
| 6,527,583 | B2 | 3/2003 | Plate |
| 6,540,532 | B1 | 4/2003 | Martin et al. |
| 6,544,054 | B2 | 4/2003 | Ishikawa et al. |
| 6,558,176 | B1 | 5/2003 | Martin et al. |
| 6,602,082 | B2 | 8/2003 | Nishide et al. |
| 6,641,423 | B1 | 11/2003 | Giro |
| 6,652,306 | B2 | 11/2003 | Karamatsu et al. |
| 6,733,312 | B2 | 5/2004 | Fujii |
| 6,767,231 | B1 | 7/2004 | Martin et al. |
| 6,790,101 | B1 | 9/2004 | Data et al. |
| 6,846,191 | B2 | 1/2005 | Hobbs et al. |
| 6,869,321 | B1 | 3/2005 | Ashby et al. |
| 6,896,531 | B2 | 5/2005 | Bakker et al. |
| 6,948,959 | B2 | 9/2005 | Miyamoto |
| 7,025,610 | B2 | 4/2006 | Demuth |
| 7,048,597 | B2 | 5/2006 | Chen |
| 7,063,547 | B2 | 6/2006 | Toyoda et al. |
| 7,063,548 | B2 | 6/2006 | Ohara |
| 7,090,518 | B1 | 8/2006 | Osada et al. |
| 7,134,901 | B2 | 11/2006 | Okura |
| 7,137,835 | B2 | 11/2006 | Shiga |
| 7,150,640 | B2 | 12/2006 | Fukui et al. |
| 7,172,442 | B2 | 2/2007 | Fukatsu |
| 7,175,451 | B2 | 2/2007 | Shuey |
| 2005/0124231 | A1 | 6/2005 | Okamoto et al. |
| 2005/0204538 | A1 | 9/2005 | Dittmann |
| 2006/0264081 | A1 | 11/2006 | Osada et al. |
| 2007/0020978 | A1 | 1/2007 | Murakami et al. |
| 2007/0026706 | A1 | 2/2007 | Matsubara et al. |
| 2007/0032107 | A1 | 2/2007 | Matsubara et al. |

ELECTRICAL CONNECTOR

BACKGROUND

An electrical connector comprising a housing including electrical contacts may mate with a header including electrical contacts. The electrical contacts of the housing and the header may be of various sizes and arranged according to a predetermined pairing between the contacts of the housing and the contacts of the header to establish electrical communication between the pairs of contacts. Because of the predetermined pairing of the contacts, the housing and the header must often be arranged in a particular orientation so that they may be connected. When the housing and the header are mated they are often not oriented correctly such that the correct housing contacts and the correct header contacts connect. If an attempt is made to mate the housing and header in an incorrect orientation, the contacts may be bent or damaged. The functionality of the electrical connector is thereby impaired.

It is also helpful if the contacts of the housing and header meet in a substantially vertical alignment. Known electrical connectors fail to sufficiently prevent housing and header contacts from meeting at an angle. When the header and housing contacts meet at an angle, the contacts may be bent or damaged. The functionality of the electrical connector is thereby impaired.

BRIEF SUMMARY

In one embodiment, an electrical connector comprises a shroud and a harness connector including at least one aperture. The harness connector may be disposed within the shroud. The electrical connector may comprise at least one electrical contact disposed in the at least one aperture. The electrical connector may comprise a cam arm operatively engaged with the harness connector wherein pivoting of the cam arm will move the harness connector with respect to the shroud such that the cam arm may pivot between an upper position wherein the harness connector is fully raised within the shroud and a lower position wherein the harness connector is fully lowered in the shroud.

DESCRIPTION OF THE DRAWINGS

Figure 1:
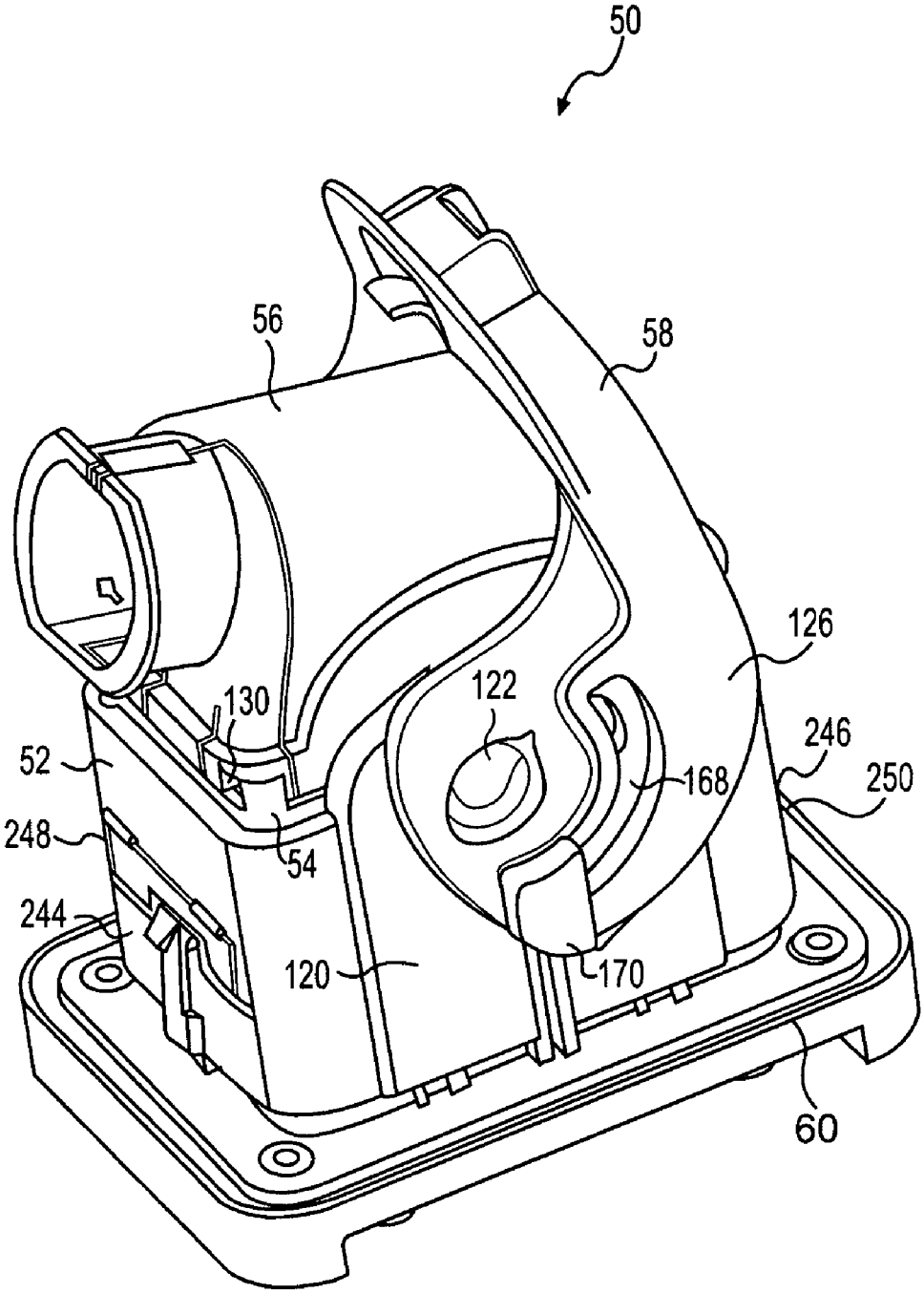
FIG. 1 is a perspective view of an electrical connector.

Referring to FIG. 1, there is shown an electrical connector 50 comprising a shroud 52, a harness connector 54 disposed within the shroud 52, a hood 56, a cam arm 58, and a header 60. The cam arm 58 may be operatively engaged with the harness connector 54 such that pivoting of the cam arm 58 will move the harness connector 54 with respect to the shroud 52. The cam arm 58 may pivot between an upper position wherein the harness connector 54 is fully raised within the shroud 52 and a lower position wherein the harness connector 54 is fully lowered in the shroud 52. The hood 56 and the header 60 may be selectively attached to the electrical connector 50 and may be removed.

Figure 2:
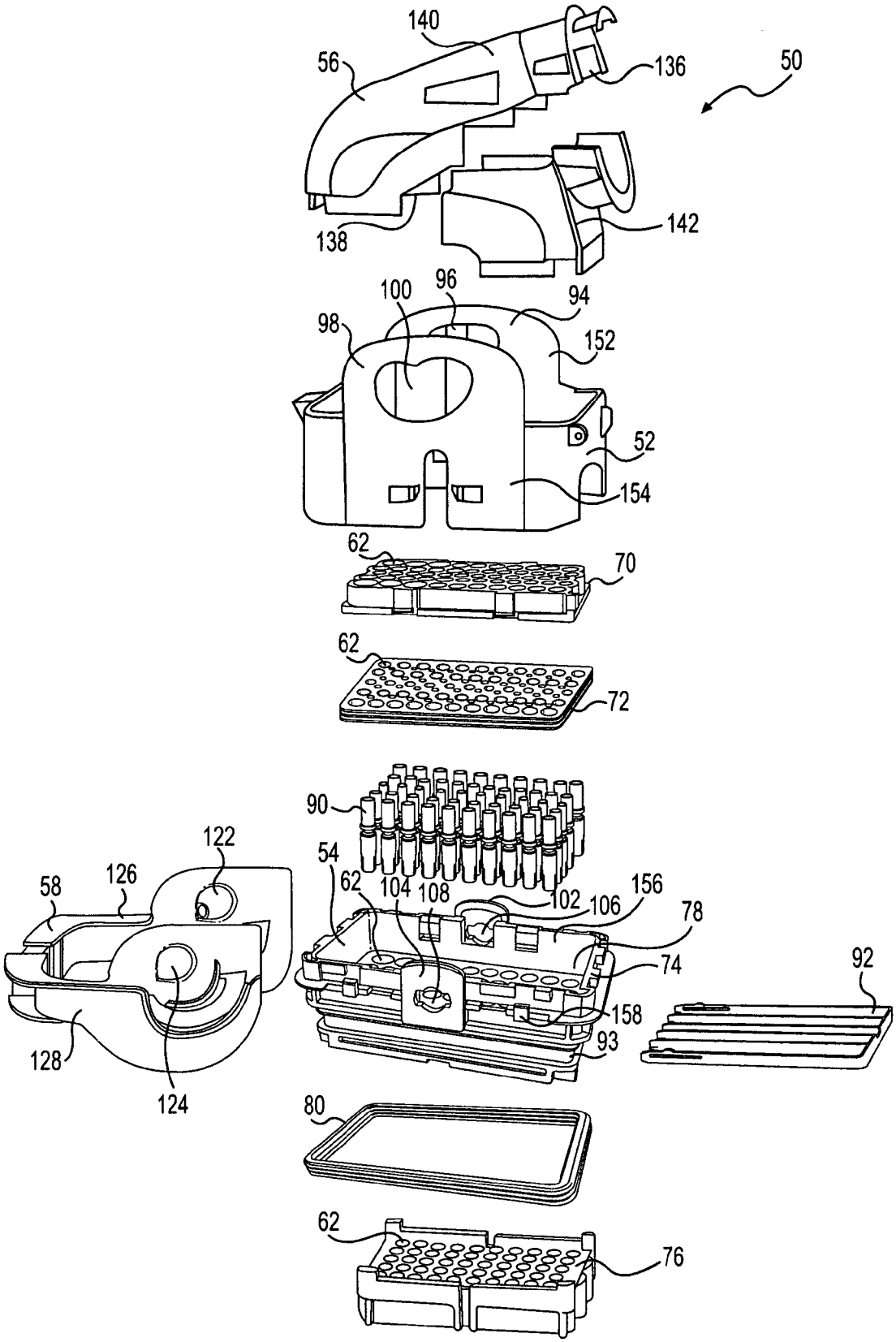
FIG. 2 is a perspective exploded view of the electrical connector.
Figure 3:
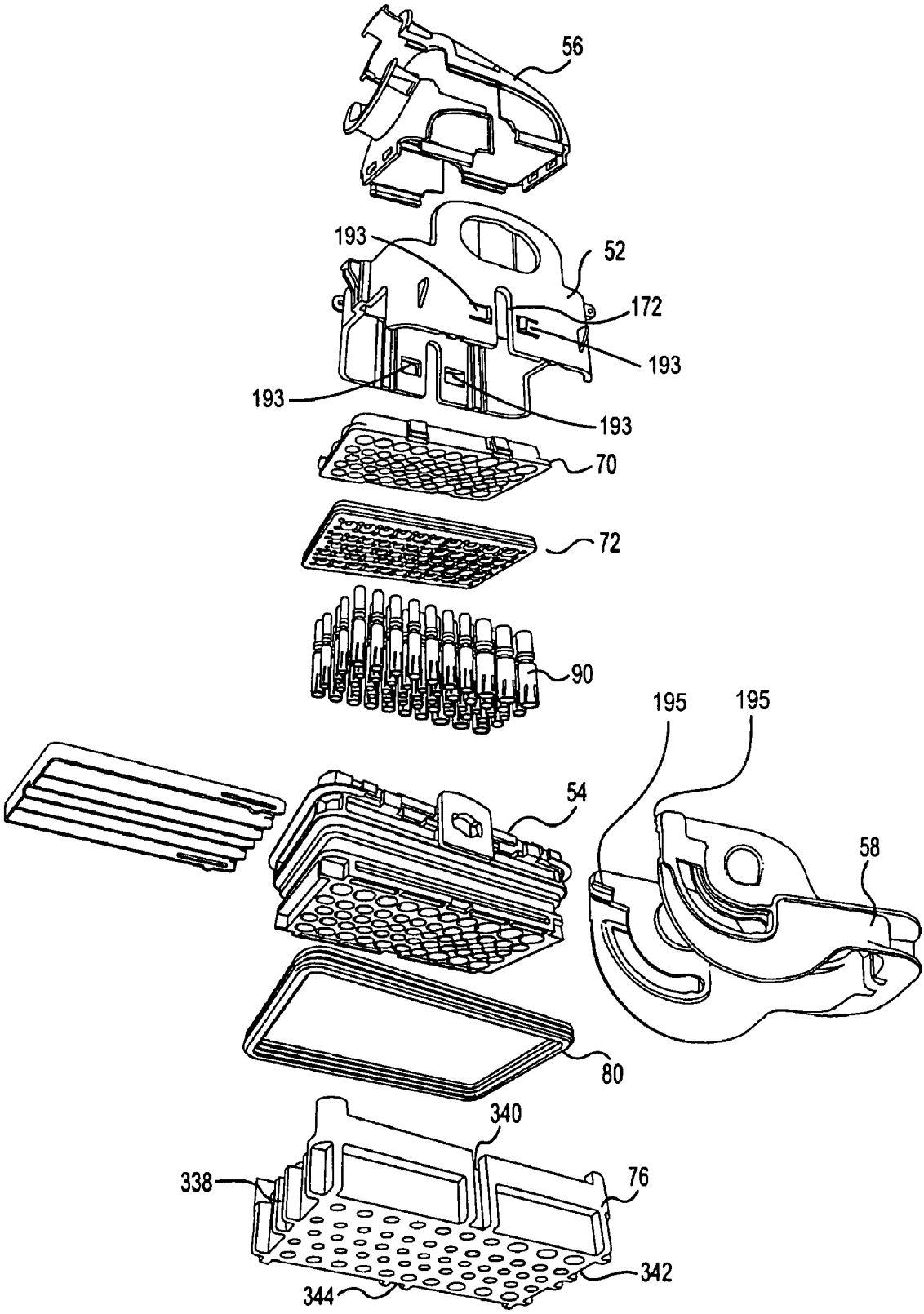
FIG. 3 is another perspective exploded view of the electrical connector.

FIGS. 2 and 3 show an exploded assembly of the electrical connector 50 without the header. The harness connector 54 may include a back plate 70, a wire grommet 72, a socket body 74, and a front plate 76. The front plate 76 may be sonically welded to the socket body 74. The socket body 74 may include a compartment 78 to receive the wire grommet 72 and the back plate 70. The wire grommet 72 may be placed into the socket body 74. The back plate 70 may be snapped into the socket body 74. A perimeter seal 80 may be placed around the socket body 74. The apertures 62 may pass through the back plate 70, the wire grommet 72, the socket body 74, and the front plate 76.

The harness connector 54 may include a plurality of apertures 62 that pass from the upper end of the harness connector 64 to the lower end thereof. The apertures 62 may be configured to receive a plurality of contacts 90 in order to establish an electrical path through the harness connector 54. The electrical contacts 90 may be received by the apertures 62 such that they are disposed within the harness connector 54. The electrical connector 50 may also include a secondary lock 92 that may be slidably engaged with the electrical connector 50. The secondary lock 92 may be inserted and removed from a slot 93 in the harness connector 54.

Figure 17:
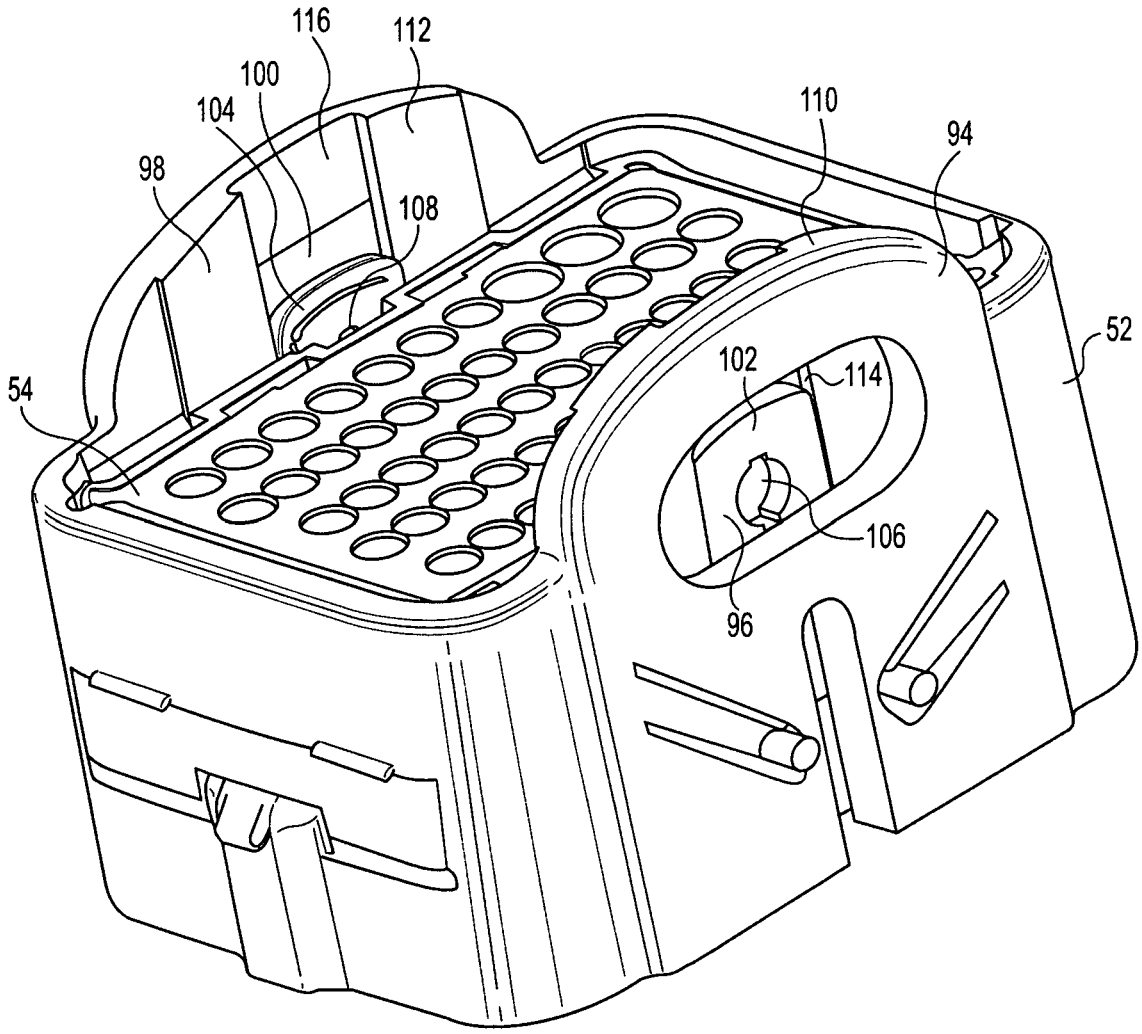
FIG. 17 is a perspective view of the harness connector inserted into the shroud of the electrical connector.

Referring to FIG. 2, the shroud 52 may receive the harness connector 54 such that the harness connector 54 may be disposed therein. The shroud 52 may include a first tab 94 including a first opening 96 and a second tab 98 including a second opening 100. The harness connector 54 may include a first projection 102 and a second projection 104 including a first fulcrum slot 106 and a second fulcrum slot 108, respectively. Referring to FIG. 17, the inside surfaces 110, 112 of the first and second tabs 94, 98 of the shroud 52 may include first and second channels 114, 116, respectively. When the harness connector 54 is disposed inside the shroud 52, the first and second projections 102, 104 of the harness connector 54, may be slidably disposed within the first and second channels 114, 116, respectively. The first opening 96 may communicate with the first fulcrum slot 106 and the second opening 100 may communicate with the second fulcrum slot 108.

Referring to FIG. 1, the cam arm 58 may be attached to the outside 120 of the shroud 52 such that the cam arm 58 operatively engages the harness connector. Referring to FIG. 3, the cam arm 58 may include a first fulcrum 122 and a second fulcrum 124 disposed on first and second sides 126, 128, respectively, of the cam arm 58. The first and second fulcrums 122, 124 of the cam arm may pass through the first and second openings 96, 100 of the first and second tabs 94, 98, respectively, of the shroud 52 to operatively engage the first and second fulcrum slots 106, 108, respectively, of the harness connector 54.

Referring to FIG. 1, the hood 56 may be attached to the harness connector 54 at the top end 130. Referring to FIG. 2, the hood 56 may include a first opening 136 and a second opening 138. The hood 56 may be comprised of upper and lower pieces 140, 142. The upper and lower pieces 140, 142 may be snapped together to assemble the hood 56. The hood 56 and the shroud 52 may combine to protect the harness connector 54 and contacts 90 from dirt and debris.

Figure 4:
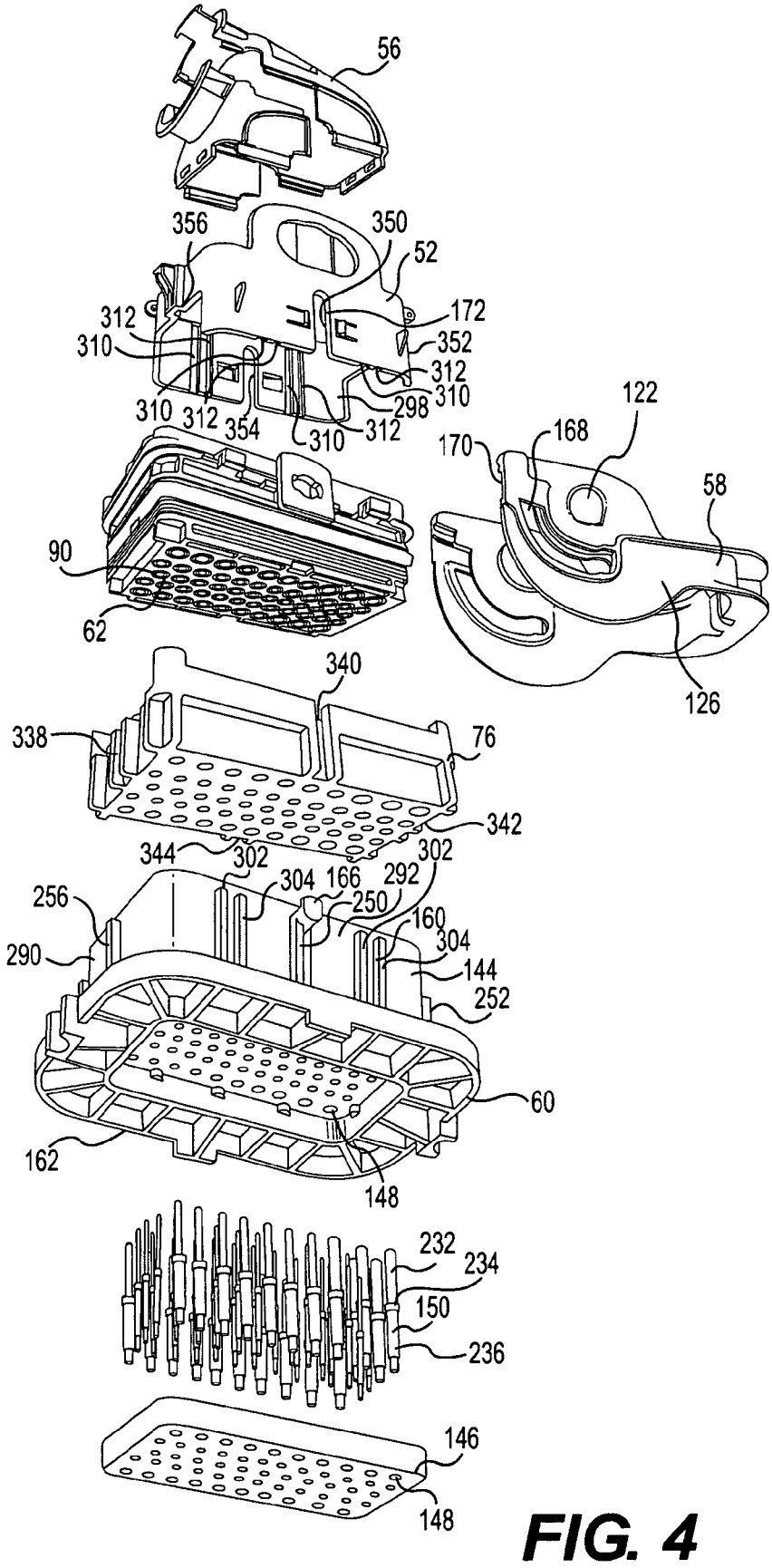
FIG. 4 is another perspective exploded view of the electrical connector.

Referring to FIG. 4, the header 60 may include a body 144 and a bottom plate 146. The body 144 of the header 60 may receive the bottom plate 146 such that the bottom plate 146 is disposed therein. The header 60 may include a plurality of apertures 148 configured to receive a plurality of electrical contacts 150. The electrical contacts 150 may be pins. The pins 150 may pass through the bottom plate 146 and the body 144.

Referring to FIG. 2, the first and second sides 126, 128 of the cam arm 58 may be similarly, configured. Accordingly, only the first side 126 of the cam arm 58 will be described in detail. The first and second sides 152, 154 of the shroud 52 may be similarly configured. Accordingly, only the first side 152 of the shroud 154 will be described in detail. The first and second sides 156, 158 of the harness connector 54 may be similarly configured. Accordingly, only the first side 156 of the harness connector will be described in detail. Referring to FIG. 4, the first and second sides 160, 162 of the header may be similarly configured. Accordingly, only the first side 160 of the header 60 will be described in detail.

Figure 5:
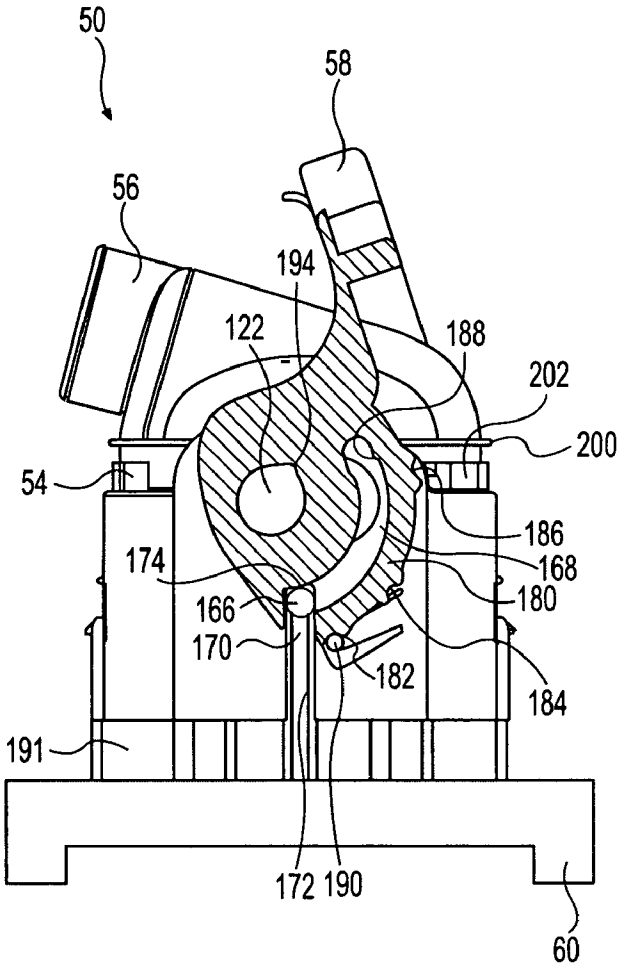
FIG. 5 is a partial cross sectional view of another embodiment of the electrical connector with the cam arm in the first detent position.

Referring to FIG. 4, the first side 160 of the header includes a cam arm post 166. The first side 126 of the cam arm 58 includes the fulcrum 122, and a post slot 168 including a post slot opening 170 configured to receive the cam arm post 166 when the header 60 is attached to the electrical connector 50. The shroud 52 may include a post slot 172 configured to receive the cam arm post 166. Referring to FIG. 5 the post slot 172 of the shroud 52 may receive the cam arm post 166 when the header 60 is attached to the electrical connecter 50. The cam arm post 166 may be disposed at the first distal end 174 of the post slot 172 when the shroud 52 and the header 60 are fully attached. The post slot 168 of the cam arm 58 may also receive the cam arm post 166 through the post slot opening 170.

Figure 6:
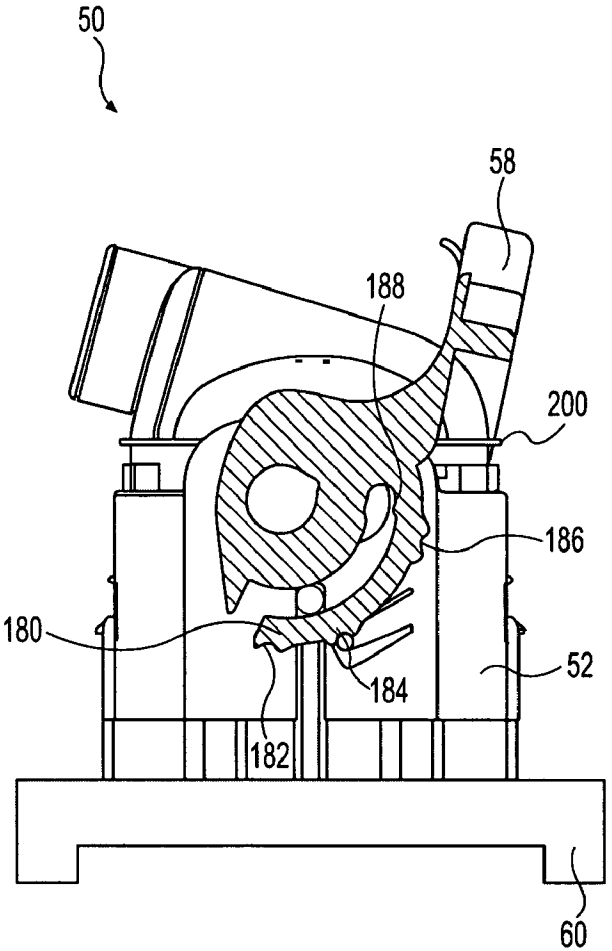
FIG. 6 is a partial cross sectional view of the electrical connector with the cam arm in the second detent position.
Figure 8:
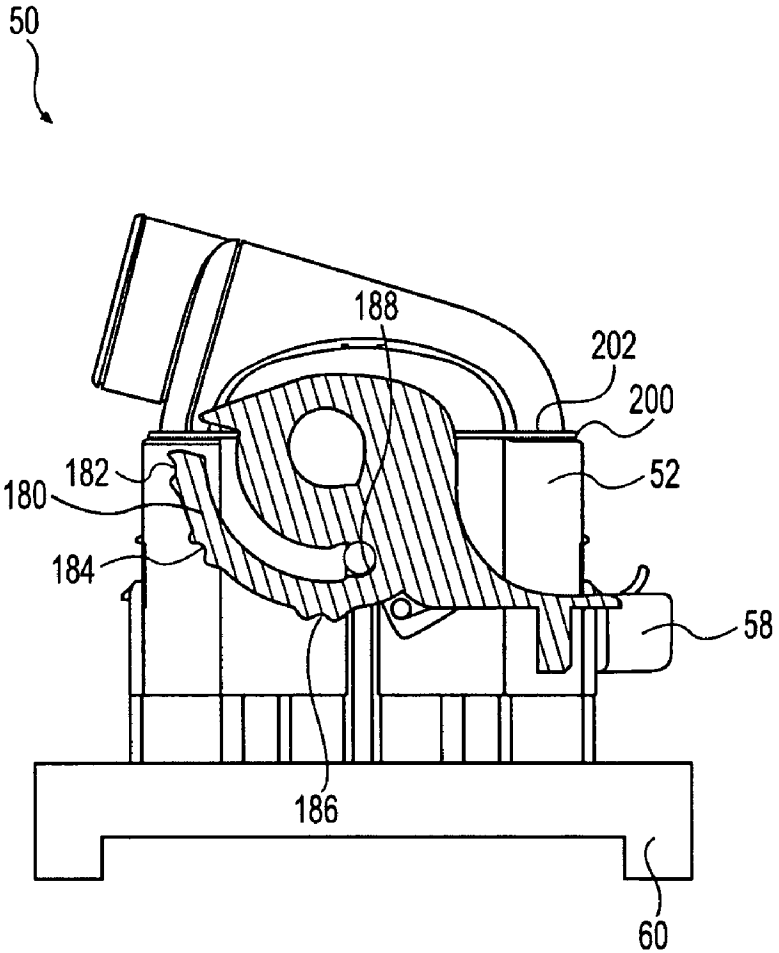
FIG. 8 is a partial cross sectional view of the electrical connector with the cam arm in the fourth position.
Figure 7:
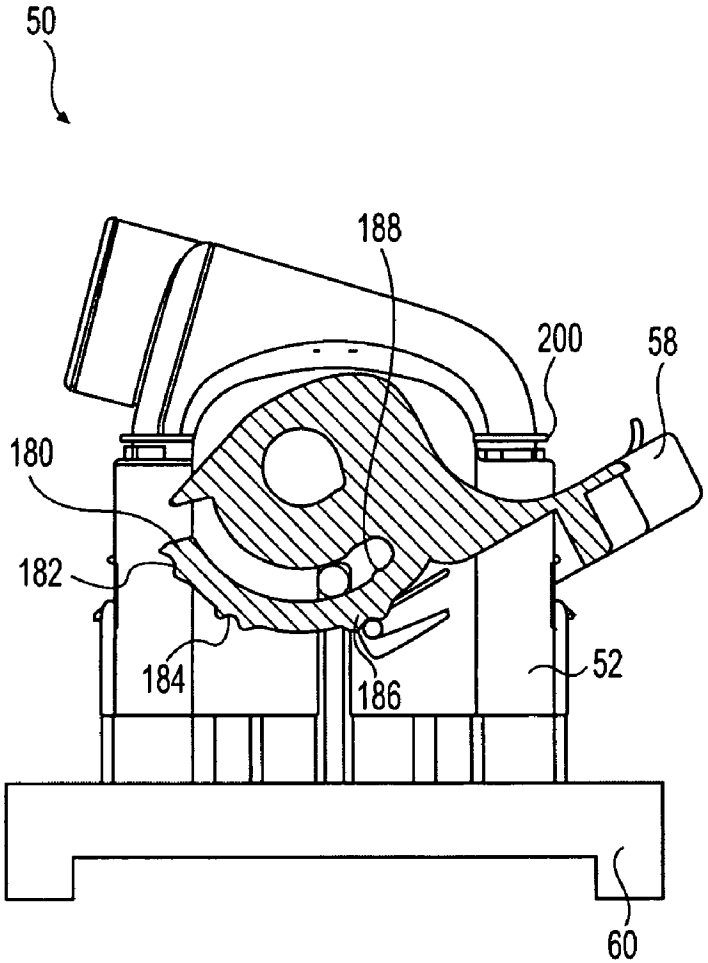
FIG. 7 is a partial cross sectional view of the electrical connector with the cam arm in the third detent position.

Referring to FIG. 5, the cam arm 58 may include a detent arm 180 including a first detent 182, a second detent 184, a third detent 186, and a fourth detent 188. The shroud 52 may include a detent tab 190 that engages the first, second, and third detents 182, 184, 186 to locate the cam arm 58 at predetermined positions. In other embodiments, the detent tab may have another shape, such as, the rectangular detent tab 193 as shown in FIG. 3. The shroud may have one, two, three or four detent tabs. The detent tab 193 may engage the detent 195 and may assist in holding the cam arm in an upper position. Referring to FIG. 5 the first detent 182 may correspond to the upper position of the cam arm 58. Referring to FIG. 6, the second detent 184 may correspond to the upper-mid position of the cam arm 58. Referring to FIG. 7, the third detent 186 may correspond to the lower-mid position of the cam arm 58. Referring to FIG. 8, the fourth detent 188 may correspond to the lower position of the cam arm 58. The fourth detent 188 may be located in the post slot 168 and be engaged by the cam arm post 166.

Referring to FIG. 5, when the cam arm 58 is in the upper position, the header 60 may be attached to the bottom end 191 of the shroud 52. In the upper position, the post slot opening 170 may align with the post slot 172 of the shroud 52 such that the cam arm post 166 may be received by the post slots 168, 172 of the shroud 52 and cam arm 58. The upper position of the cam arm 58 may be the only cam arm position that allows for the header 60 to be fully attached to the electrical connector 50.

Figure 16:
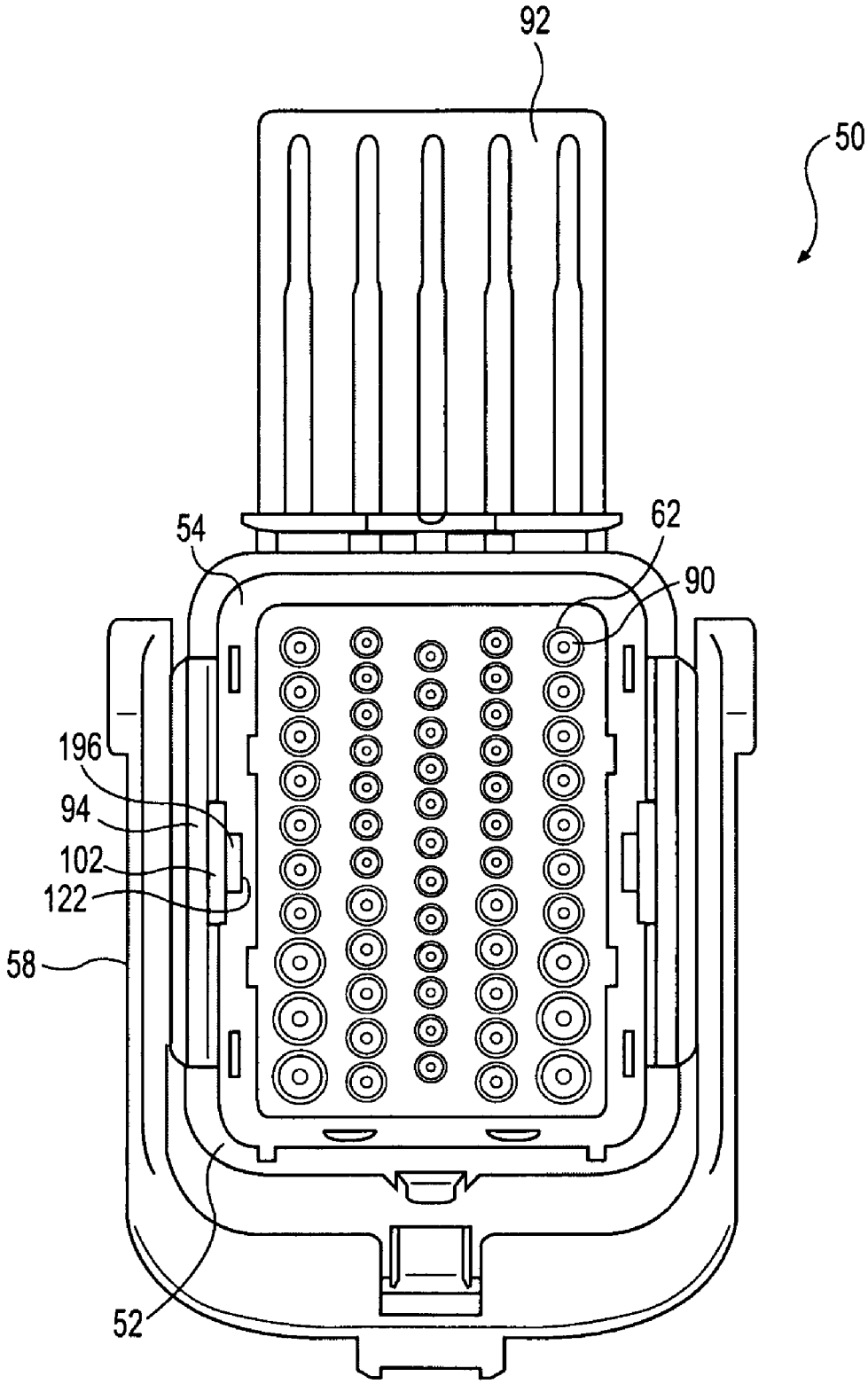
FIG. 16 is a top plan view of the electrical connector wherein the secondary lock is partially withdrawn.
Figure 18:
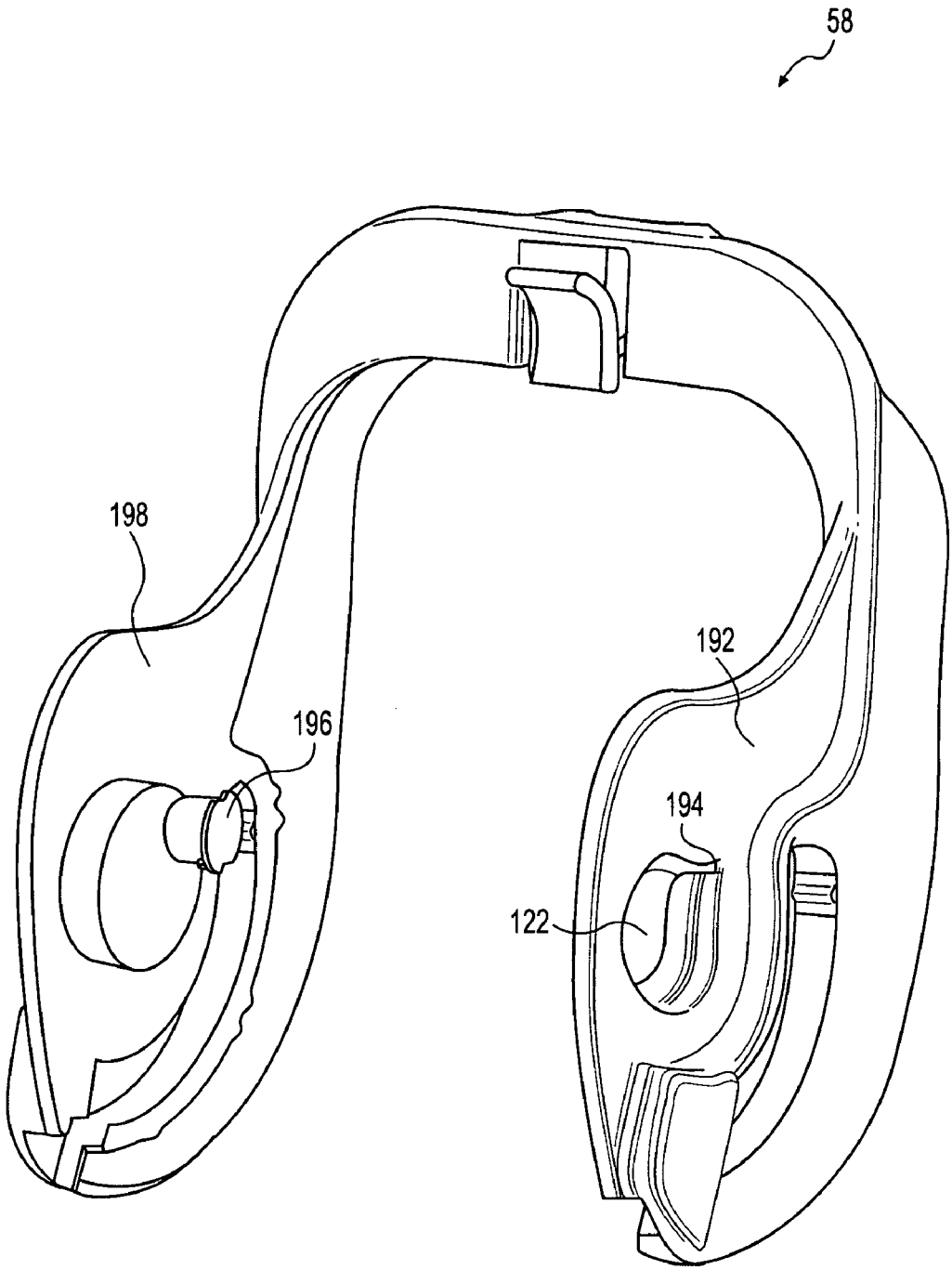
FIG. 18 is a perspective view of the cam arm of the electrical connector.

Referring to FIG. 18, on the outside surface 192 of the of the cam arm 58, the fulcrum 122 may include an axle point 194. The fulcrum 122 may include an axle 196 on the inside surface 198 of the cam arm, which corresponds to the position of the fulcrum point (for illustrative purposes, the axle 196 and the inside surface 198 are identified on the opposite side of the cam arm 58). Referring to FIG. 17, the first opening 96 of the shroud 52 and the fulcrum slot 106 of the harness connector 54 are configured to receive the axle of the fulcrum. Referring to FIG. 16, the axle 196 of the fulcrum 122 may thereby pass through the tab 94 of the shroud 52 and the projection 102 of the header 54 when the cam arm 58 is attached to the electrical connector 50.

Figure 19:
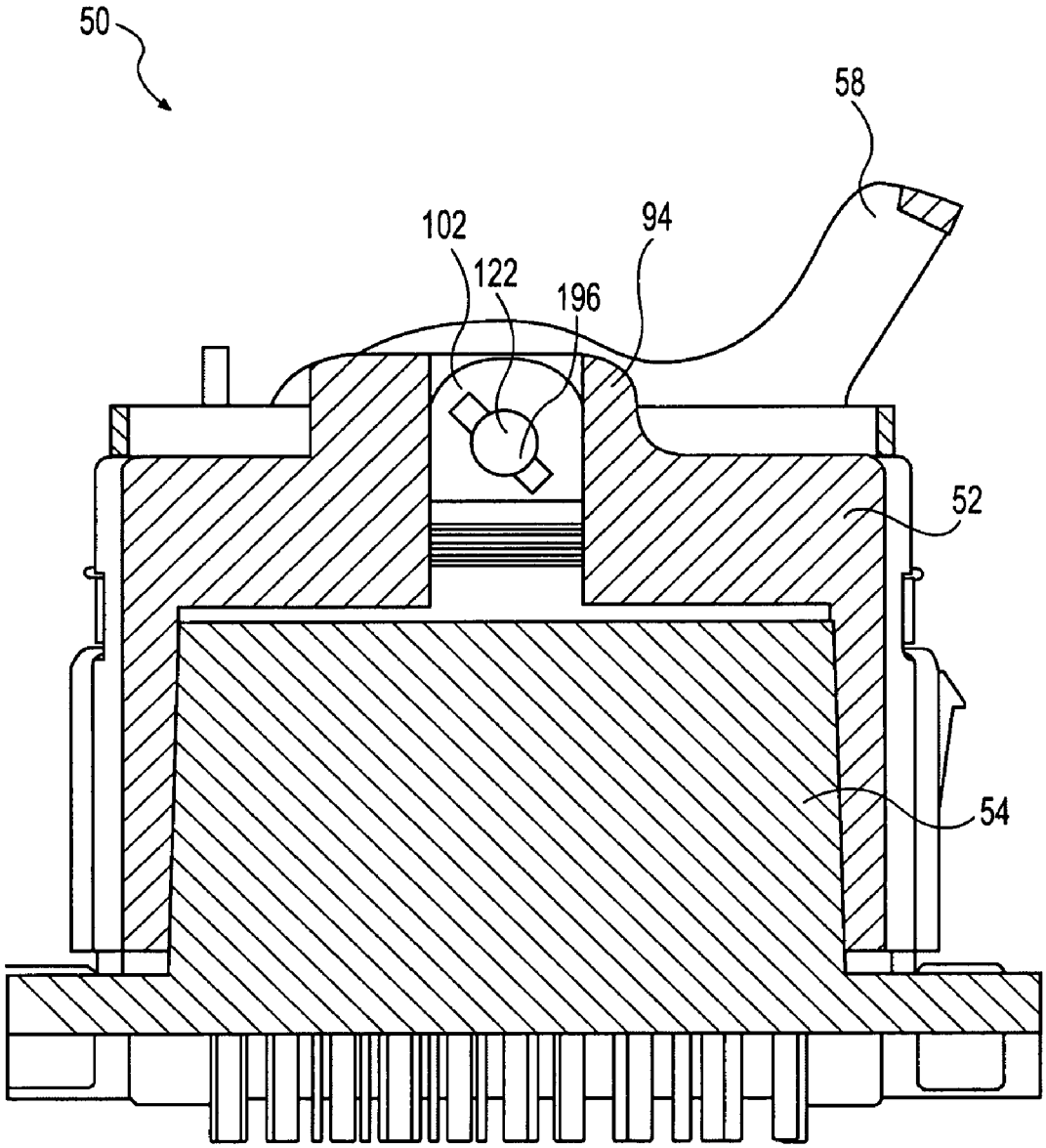
FIG. 19 is a cross sectional view of the electrical connector.
Figure 20:
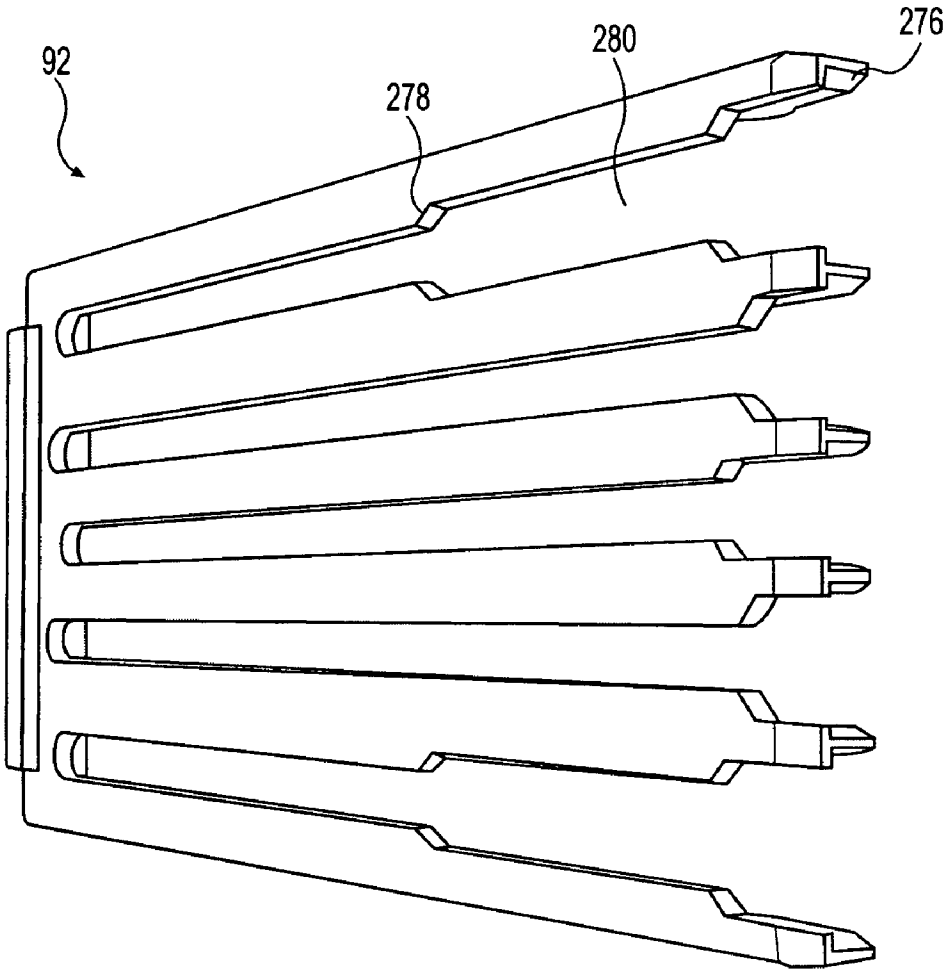
FIG. 20 is a perspective view of the secondary lock of the electrical connector.

Referring to FIG. 5, when the cam arm 58 is in the upper position the axle of the fulcrum 122 may be in its uppermost position, as evidenced by the fulcrum point 194. As the cam arm 58 pivots to the upper-mid position as shown in FIG. 6, the lower-mid position as shown in FIG. 7, and the lower position as shown in FIG. 8, the axle pivots to its lowermost position. As the cam arm 58 pivots to a lower position, the detent arm 180 of the cam arm 58 is leveraged against the cam arm post 166 so that the fulcrum 122, through the axle, applies a downward force against harness connector 54. Referring to FIG. 19, because the projection 102 of the harness connector 54 is slidably engaged with the tab 94 of the shroud 52, the axle 196 of the cam arm 58 forces the harness projection 102, and thereby the harness connector 54, down into the shroud 52 as the cam arm 58 pivots from the upper position to the lower position. The cam arm 58, the shroud 52, and the harness connector 54 thereby convert the rotation movement of the pivoting of the cam arm 58 into vertical linear movement of the harness connector 54 within the shroud 52. Referring to FIG. 5, because the hood 56 may be attached to the harness connector 54, the hood 56 may move with the harness connector 54. As the cam arm 58 pivots from the upper position, as shown in FIG. 5, to the lower position, as shown in FIG. 8, the lip 200 of the hood 56 may move from a position above the top 202 of the shroud 52, as shown in FIG. 5, to a position where the lip 200 is flush against the top 202 of the shroud 52, as shown in FIG. 8. As the cam arm 58 is pivoted from the lower position to the upper position, the movement of the harness connector 54 and hood 56 may be reversed so that the cam arm 58 may be pivoted back and forth between the upper position and the lower position repeatedly. The cam arm 58 may be pivoted from the upper position to the lower position, and vice-versa, in a single stroke.

Figure 9:
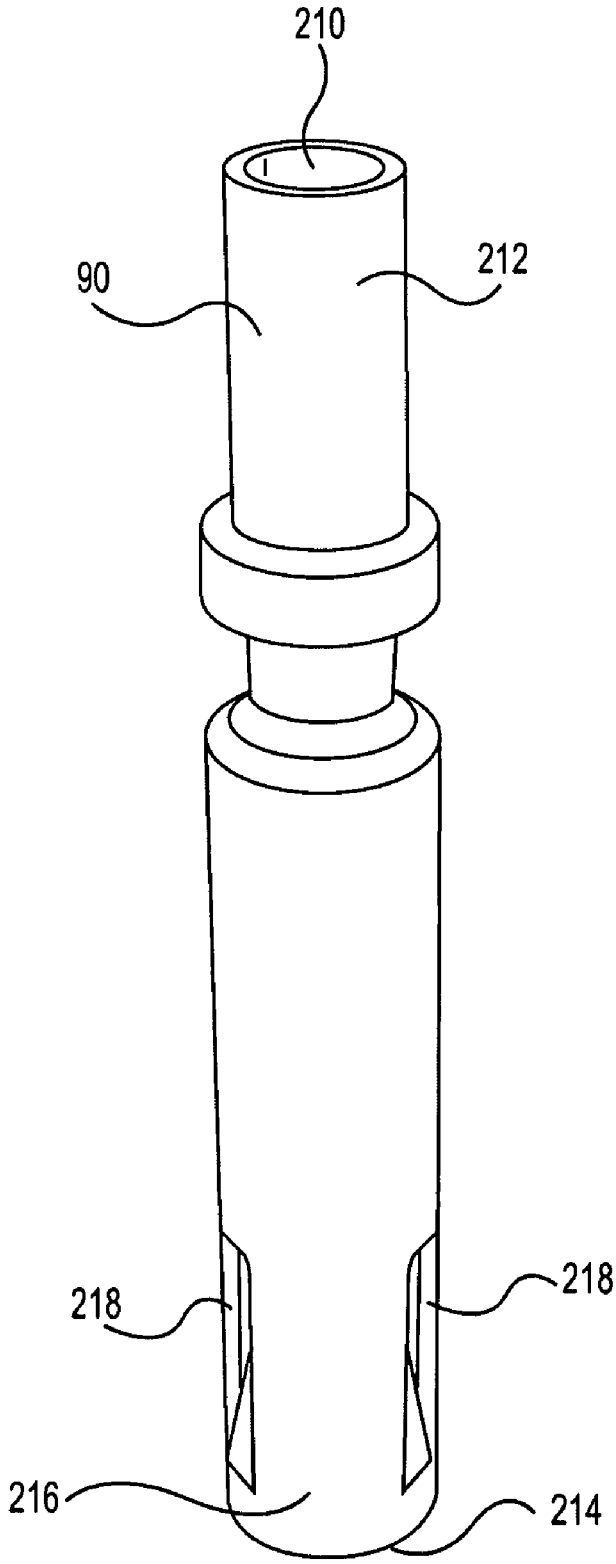
FIG. 9 is a perspective view of an electrical contact.

Referring to FIG. 2, the harness connector 54 may receive a plurality of contacts 90 wherein each contact 90 is disposed in a single aperture 62. Referring to FIG. 9, the contact 90 may be tubular and configured to receive a wire at a first opening 210 at a first distal end 212 and a pin at a second opening 214 at a second distal 216 end to establish an electrical connection between the wire and the pin. The contact 90 may include retention portions 218. The contact 90 may be produced by stamping, forming, machining, deep drawing and/or other methods of manufacture Referring to FIG. 2, the apertures 62 and the corresponding contacts 90 of the harness connector 54 may be arranged in predetermined pattern that may correspond to the pattern of pins on the header.

Referring to FIG. 2, the electrical contacts 90 may be of various sizes in order to accommodate wires and pins of various sizes. In one embodiment, the contact 90 may be sized to accommodate a wire of 10-12 awg. In another embodiment, the contact 90 may be sized to accommodate a wire of 14-16 awg. In another embodiment, the contact may be sized to accommodate a wire of 18-20 awg. In other embodiments, the contact may be sized to accommodate wires of other sizes. The connector may be configured to receive GXL or TXL wire insulation or other wire insulation.

Figure 10:
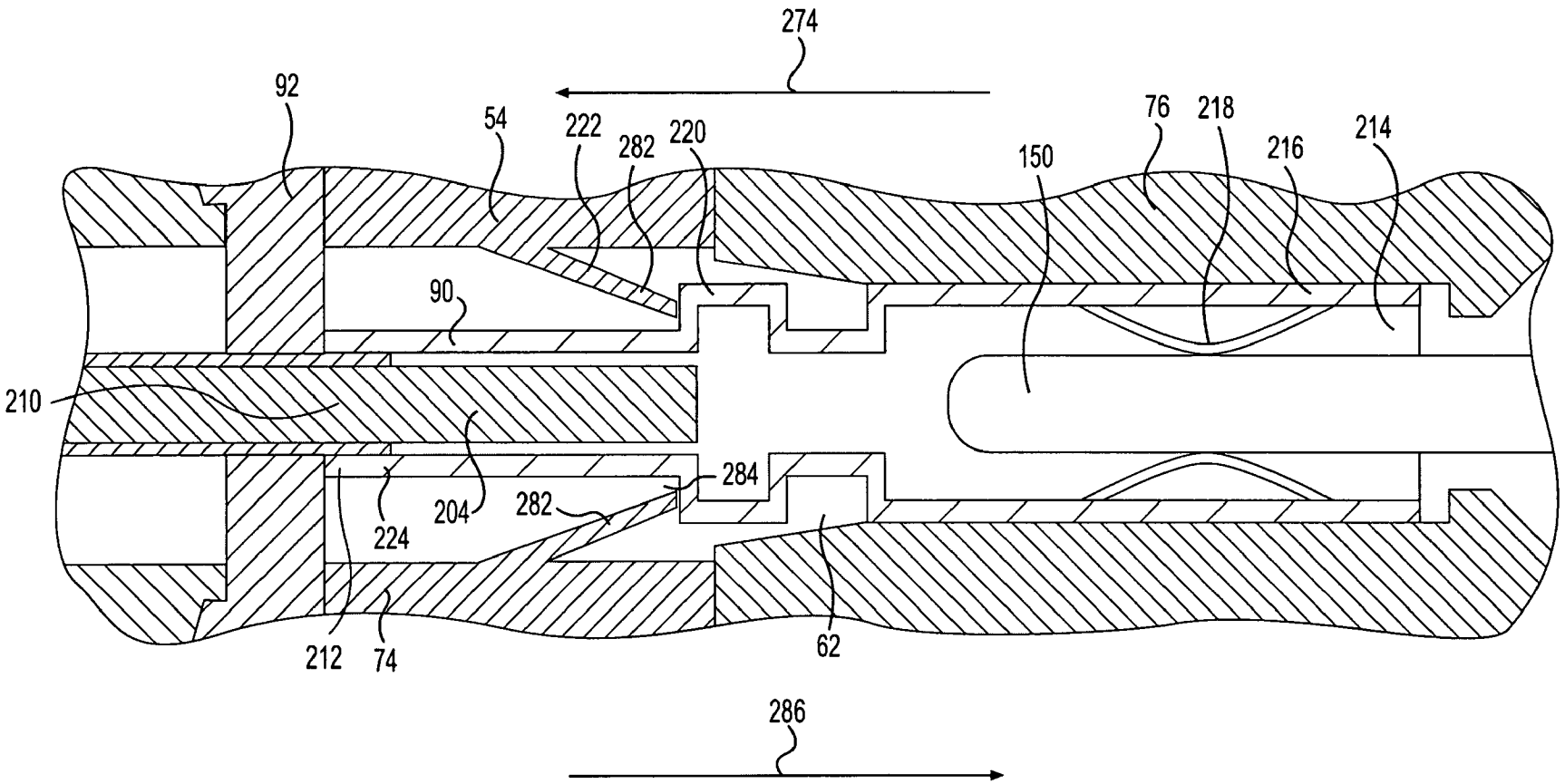
FIG. 10 is partial cross sectional view of the electrical connector, and an electrical contact.

Referring to FIG. 10, the contact 90 of the harness connector 54 may be disposed within the aperture 62 so that it does not project out of the harness connector 54. The contact 90 may be disposed within the socket body 74 and the front plate 76. The contact 90 may include a first lockable feature 220, for example a collar, which interacts with a primary lock 222 of the harness connector 54. The contact 90 may also include a second lockable feature 224, for example the first distal end 212 of the contact 90, which interacts with a secondary lock 92 of the harness connector 54. The primary and secondary locks 222, 92 may help retain the contact 90 in position within the aperture 62. The contact 90 may receive first and second electrical elements 204, 150 in order to establish electrical communication therebetween. The contact 90 may receive a wire 204 through the first opening 210. The contact 90 may receive a pin 150 of the header through the second opening 214. Proximate the second distal end 216, the contact 90 may include retention portions 218 configured to retain the pin 150 therein. The retention portions 218 may retain the pin 150 within the contact 90 through a friction fit.

In one embodiment, empty apertures in the harness connector may be filled with plugs. For example, the empty apertures may be filled with seal plugs.

Referring to FIG. 4, the pins 150 of the header 60 may be arranged in a predetermined pattern that corresponds to the pattern of the contacts 90 in the harness connector 54. The pin 150 may include a first portion 232, a collar 234, and a second portion 236. The collar 234 may be disposed within the aperture 148 of the bottom plate 146. The first portion 232 may be the portion of the pin 150 that is received by the contact 90 of the harness connector 54. The pins 150 may be of various sizes. The sizes of the pins 150 may correspond to the sizes of the respective contacts 90 in which the pins 150 are inserted.

Figure 11:
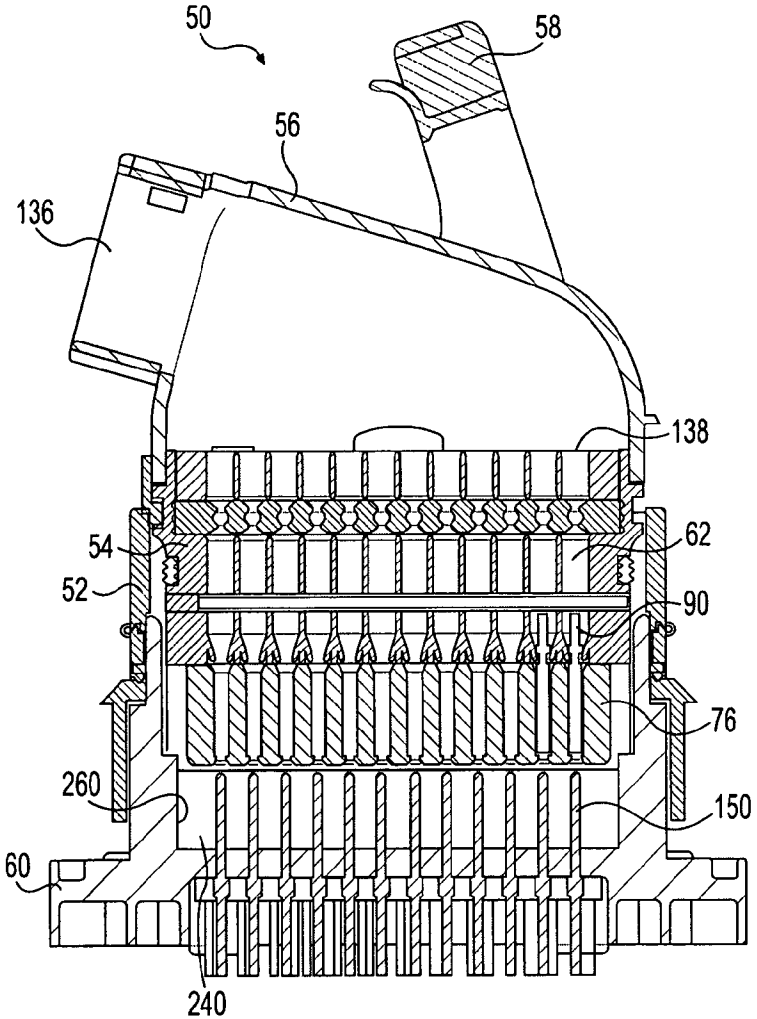
FIG. 11 is a cross sectional view of the electrical connector with the cam arm in the first detent position.

Referring to FIG. 11, when the cam arm 58 is in the upper position, the harness connector 54 may be in a raised position within the shroud 52. In the raised position, the pins 150 of the header 60 may be in a position below the harness connector 54 such that they are not inserted into the apertures 62 of the harness connector 54. Accordingly, the pins 150 are not in electrical communication with the contacts 90. In this position, the hood 56 may be located above the shroud 52.

Figure 12:
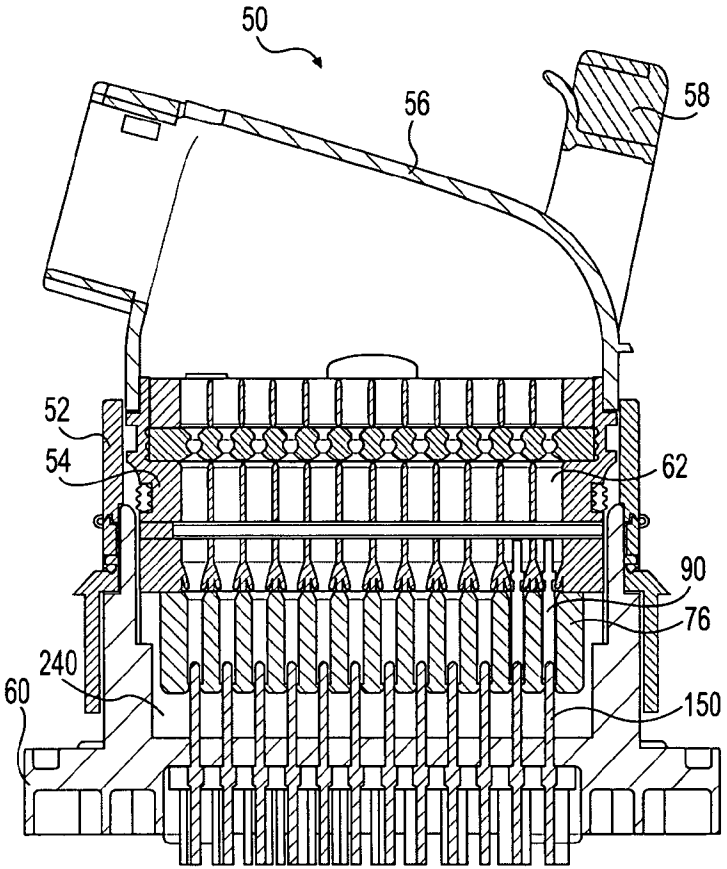
FIG. 12 is a cross sectional view of the electrical connector with the cam arm in the second detent position.
Figure 13:
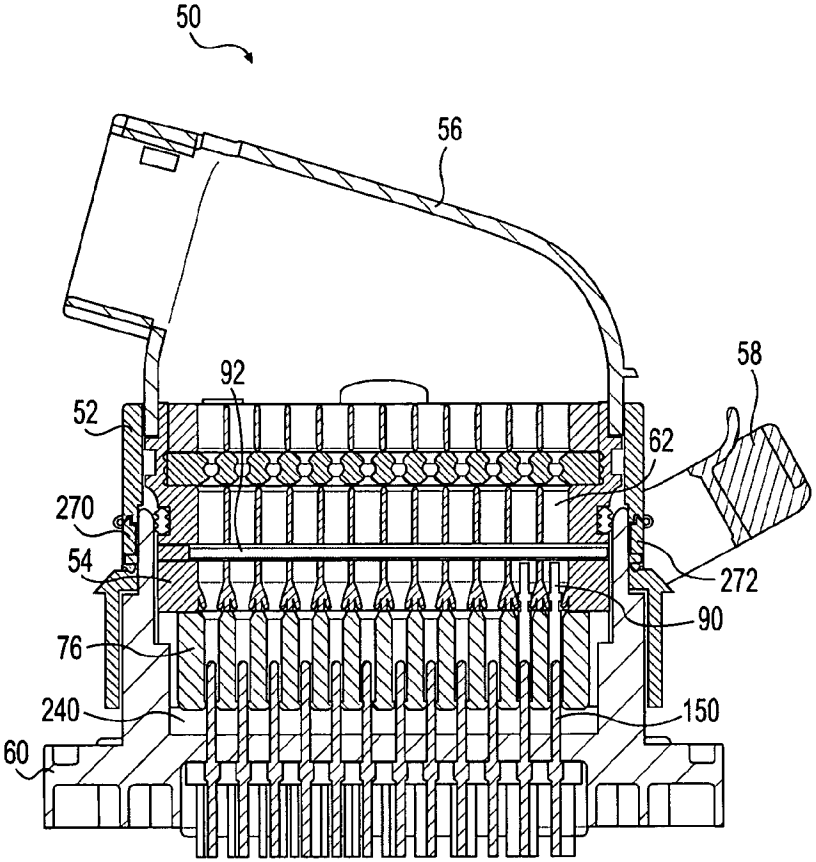
FIG. 13 is a cross sectional view of the electrical connector with the cam arm in the third detent position.

Referring to FIGS. 12 and 13, as the cam arm 58 pivots through the upper-mid and lower-mid positions, the harness connector 54 may be moved down within the shroud 52 such that the pins 150 of the header 60 enter the apertures 62 of the harness connector 54. The contacts 90 may receive the pins 150 and establish electrical communication therebetween. The header 60 may include a cavity 240 configured to receive the front plate 76 of the harness connector 54. As the cam arm 58 lowers the harness connecter 54 within the shroud 52, the front plate 76 may enter the cavity 240 and the hood 56 may begin to enter the shroud 52.

Figure 14:
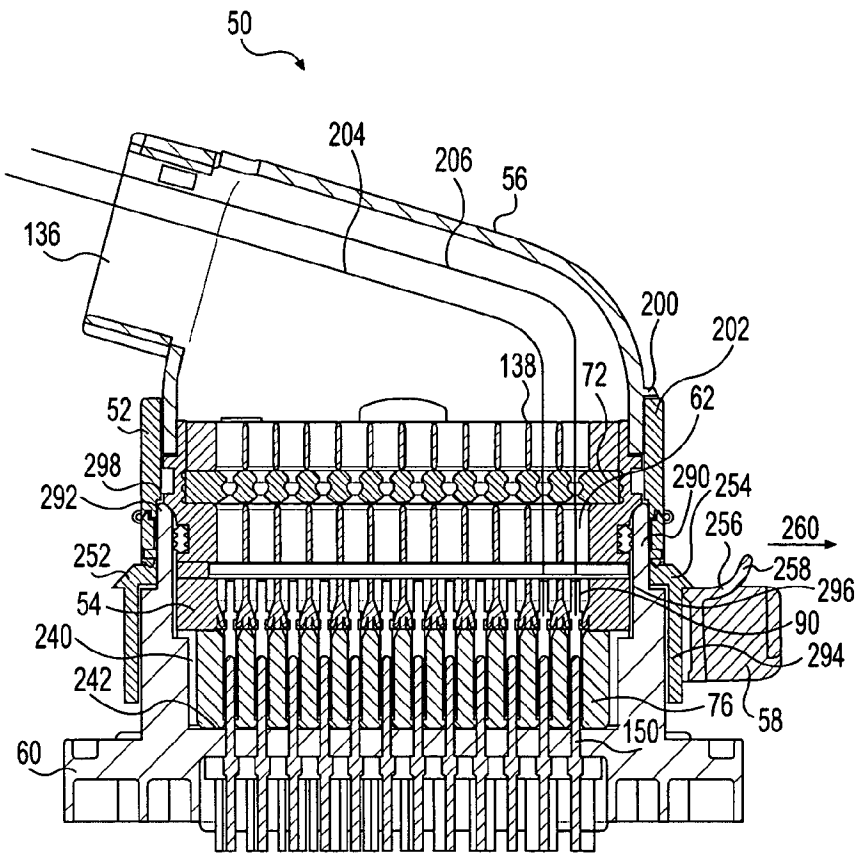
FIG. 14 is a cross sectional view of the electrical connector with the cam arm in the fourth position.

Referring to FIG. 14, when the cam arm 58 is in the lower position, the harness connector 54 may be disposed in a lowermost position within the electrical connector 50. The front plate 76 may be disposed proximate the bottom 242 of the cavity 240. The pins 150 may be fully inserted into the contacts 90, thereby establishing reliable electrical communication between the contacts 90 and pins 150. The hood 56 may be fully lowered within the electrical connector 50 such that the lip 200 of the hood 56 is flush with the top 202 of the shroud 52.

Referring to FIG. 14, the hood 56 may receive wires, such as, wires 204, 206 through the first opening 136, wherein each wire then passes through the second opening 138 of the hood 56 to be received by a contact 90 in the harness connector 54. For purposes of clarity, only two wires 204, 206 are shown in FIG. 14. The wires 204, 206 may be retained within the apertures 62 by the wire grommet 72 such that they remain engaged with the contact 90 as the harness connector 54 moves up and down according to the position of the cam arm 58. When the contacts 90 and the pins 150 are fully engaged, each wire 204, 206 may be in selective electrical communication with a particular pin 150 via a particular contact 90. The contacts 90 may be arranged in a predetermined configuration to match each wire 204, 206 with a particular pin 150.

Referring to FIG. 1, the cam arm 58 and the hood 56 may be reversibly positionable on the electrical connector 50. Referring to FIG. 1, the shroud 52 includes a front 244 and a rear 246 which correspond to a front 248 and a rear 250 of the electrical connector 50. The front 244 and rear 246 of the shroud 52 may be similarly constructed such that the front 244 and the rear 246 include similar features. Referring to FIG. 2, the shroud 52 is configured such that the harness connector 54 may only be inserted into the shroud 52 in one direction. Referring to FIG. 4, the header 60 may only be mounted in one direction on the electrical connector 50 wherein the direction is determined by the orientation of the shroud 52. The shroud 52 and harness connector 54 are configured to reversibly receive the cam arm 58 and the hood 56. Referring to FIG. 5, the cam arm 58 and the hood 56 may not be reversible with respect to each other in order that the cam arm 58 may pivot from the upper position to the lower position without interference from the hood 56.

Referring to FIG. 14, the shroud 52 may include a front flange 252 and a rear flange 254. The cam arm 58 may include a locking feature 256 configured to engage the front or rear flange 252, 254 of the shroud 52, depending on the orientation of the cam arm 58. When the cam arm 58 is in the lower position, the locking feature 256 may engage the flange 254 to retain the cam arm 58 in the lower position by an interference fit. When the cam arm 58 is locked in the lower position, the harness connector 54 is locked in the lowermost position within the electrical connecter 50, thereby maintaining full engagement between the contacts 90 and the pins 150. The cam arm 58 may be locked in the lower position when the electrical connector 50 is in an operating state. The locking feature 256 may include a tab 258. In order to disengage the locking feature 256, an operator may apply pressure to the tab 258 in a direction 260 away from the shroud 52 until the locking feature 256 disengages from the flange 254. The cam arm 58 may then be pivoted towards the upper position. In one embodiment, the cam arm 58 may include a redundant locking feature, for example a cotter pin.

Figure 15:
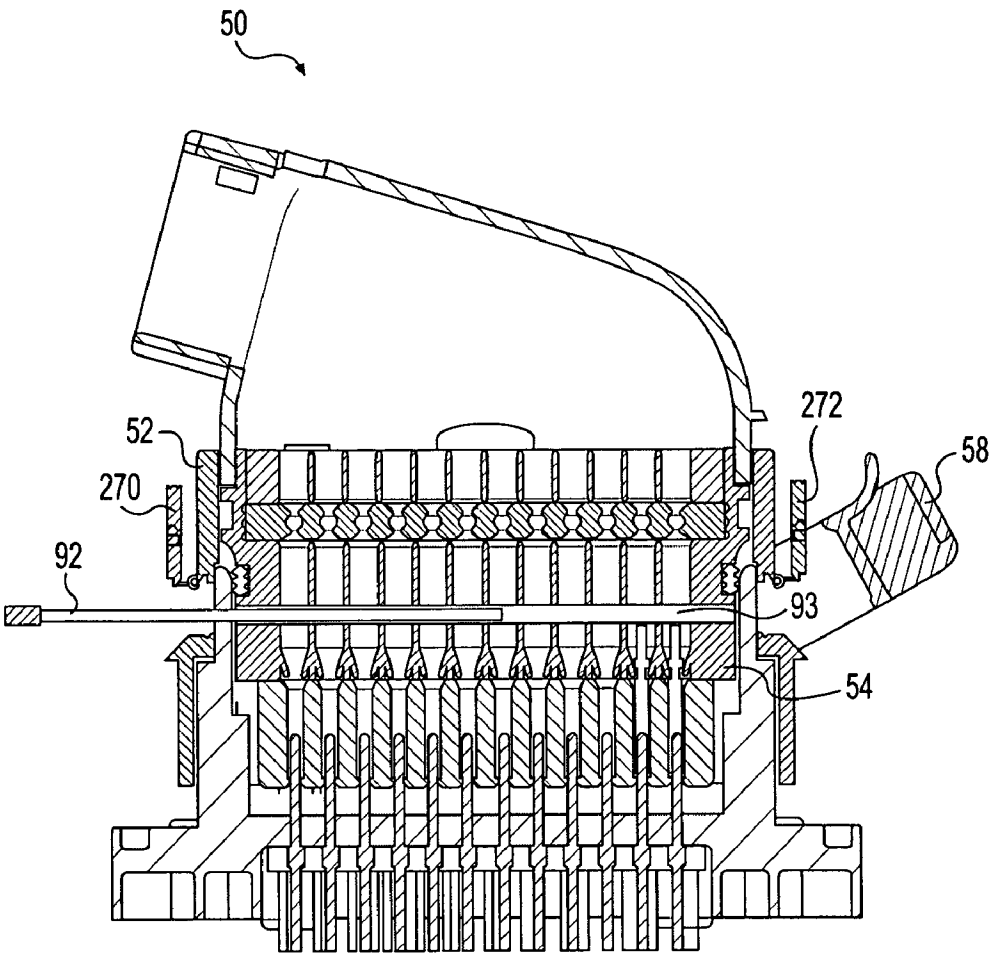
FIG. 15 is the same view as FIG. 13 except the doors are open and the secondary lock is partially withdrawn.

Referring to FIG. 13, the shroud 52 may also include a front door 270 and a rear door 272. The doors 270, 272 may be movable between a closed position, as shown in FIG. 13, and an open position, as shown in FIG. 15. Referring to FIG. 15, the slot 93 and the secondary lock 92 of the harness connector 54 may be level with the doors 270, 272 of the shroud 52 when the cam arm 58 is in the lower-mid position. When the cam arm 58 is in the lower-mid position and the door 270 opposite the cam arm 58 is open, the secondary lock 92 may be slid in and out of the slot 93 of the electrical connector 50 through door 270. In one embodiment, the secondary lock 92 may be fully removable.

Figure 21:
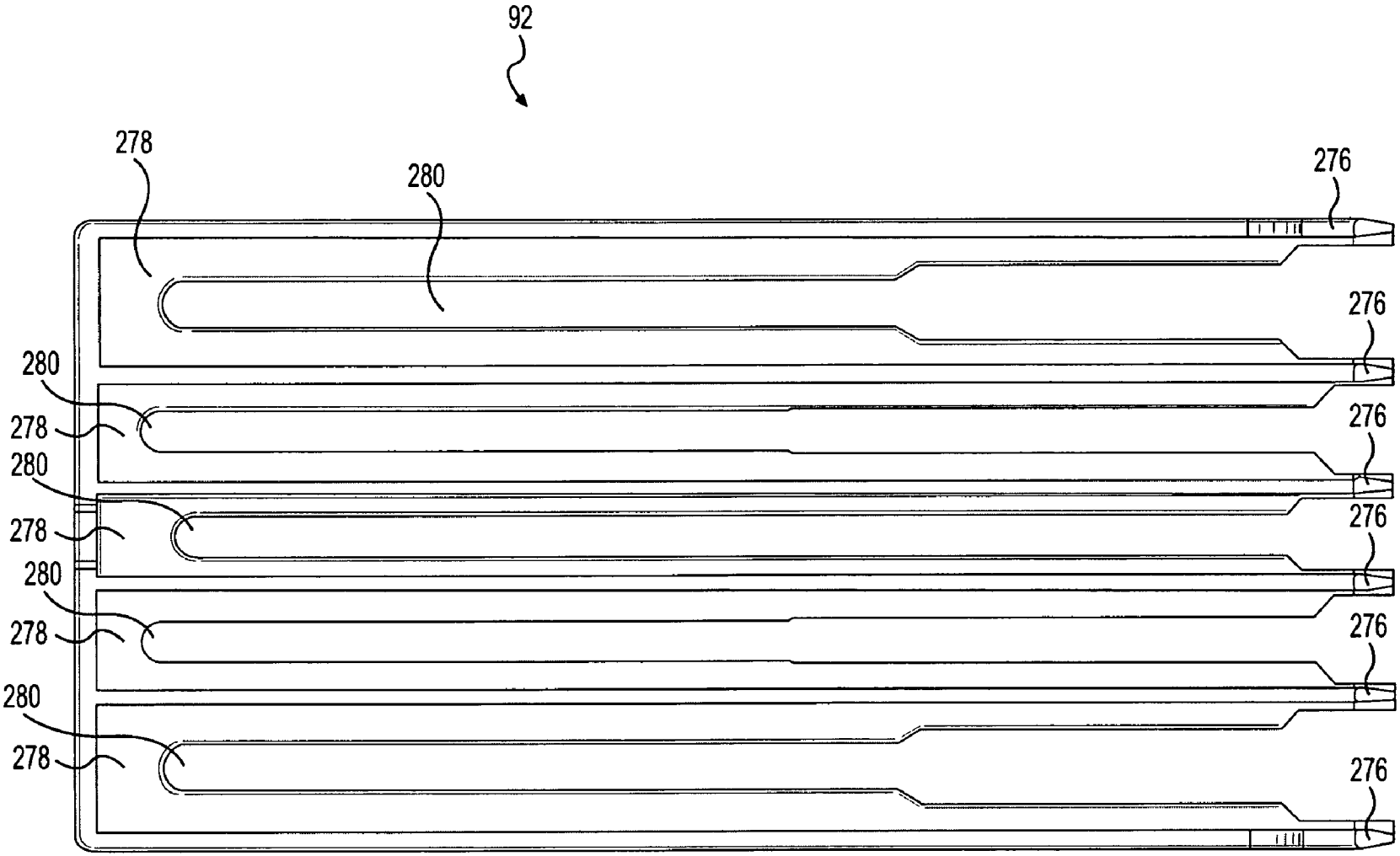
FIG. 21 is a bottom plan view of the secondary lock of the electrical connector.

Referring to FIG. 10, the primary and secondary locks 222, 92 of the harness connector 54 may work together to maintain the contact 90 in position within the aperture 62. The primary lock 222 may engage the first lockable feature 220 to prevent the contact 90 from moving in a first direction 274. When inserted, the secondary lock 92 may also prevent the contact from moving in the first direction 274. Referring to FIG. 21, the secondary lock 92 may be comprised of a plurality of fingers 276. The secondary lock 92 may include flanges 278 between the fingers 276. The flanges may 278 may include an opening 280 to permit wires to pass therethrough. The opening 280 may be narrower than the contacts. Accordingly, the secondary lock 92 may permit wires to pass therethrough, but prevent the contact from passing the secondary lock 92.

Referring to FIG. 10, to assemble the harness connector 54, the contact 90 may be inserted into the aperture 62 at the opening in the back plate until the first lockable feature 220 passes through the primary lock 222. The primary lock 222 may be a socket comprised of a plurality of fingers 282, which project into the aperture 62 at an angle. The fingers 282 may angle towards an opening 284 in a second direction 286. The second direction 286 may be opposite the first 274. The opening 284 may be narrower than the collar 220 of the contact 90 and the aperture 62. Accordingly, the fingers 282 may deflect to permit the collar 220 to pass through the opening 284 of the primary lock 222 when the contact 90 is moving in the second direction 286. However, the fingers 282 will then prevent the collar 220, and thereby the contact 90, from moving in the first direction 274. The secondary lock 92 may then be inserted behind the contact 90. The contact 90 may be prevented from shifting back towards to the opening at the back plate, thereby helping to ensure the contact 90 will remain engaged with the pin 150 after the harness connector 54 is lowered into the header.

Figure 22:
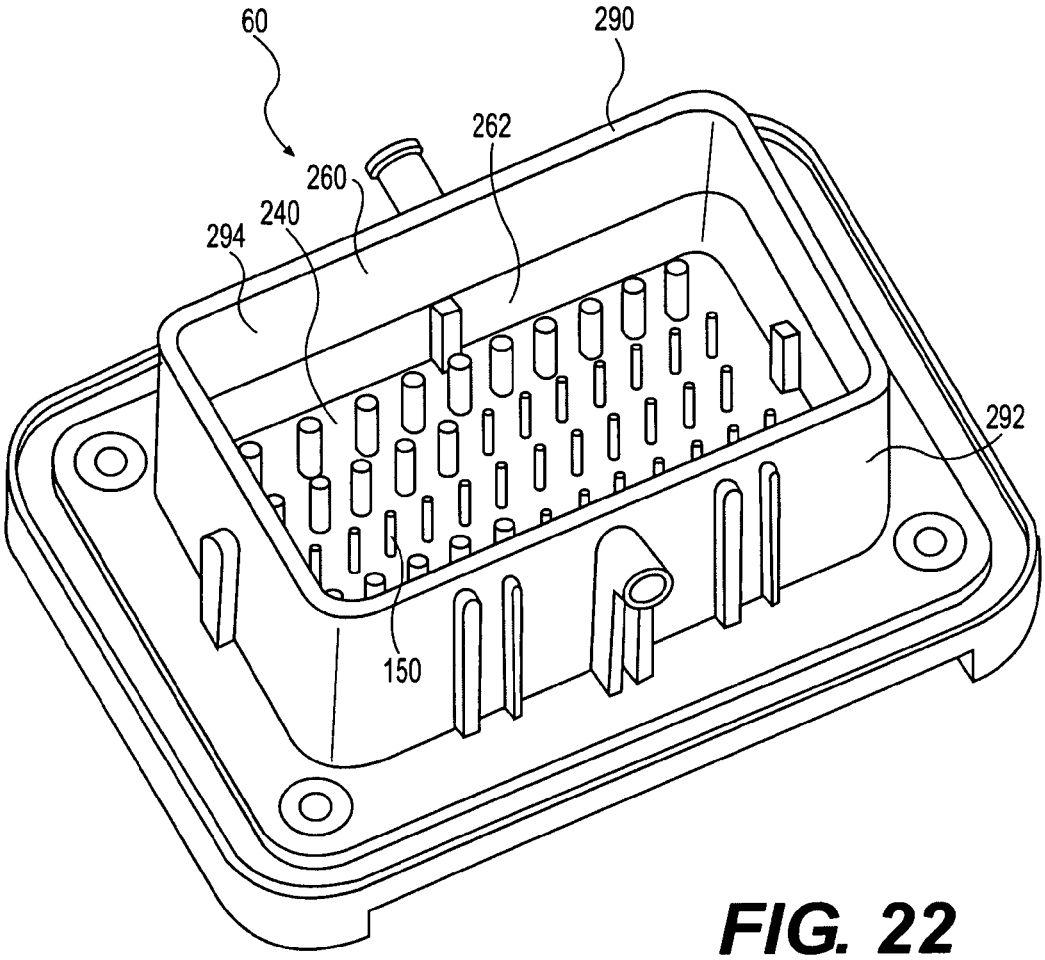
FIG. 22 is a perspective view of the header for use with the electrical connector

Referring to FIG. 22 the header 60 may include a guide wall 290 for receiving the harness connector. The guide wall 290 may include an outside surface 292 and an inside surface 294 that may define the cavity 240. Referring to FIG. 14, when the header 60 is attached to the electrical connector 50, a portion of the harness connector 54 may be disposed within the guide wall 290 such that an outside surface 296 of the harness connector 54 is disposed proximate the inside surface 294 of the guide wall 290. In addition, the shroud 52 is disposed around the guide wall 290 such that an inside surface 298 of the shroud 52 is disposed proximate the outside surface 292 of the guide wall 290. Referring to FIG. 4, the guide wall 290 may include polarization keys 302, 304 on the outside surface 292 that correspond to a key slots 310, 312 on the inside surface 298 of the shroud 52. The guide wall 290 may include thick polarization keys 302 and thin polarization keys 304 that correspond with thick key slots 310 and thin key slots 312, respectively. The engagement of the thick keys 302 with the thick slots 310 and the thin keys 304 with the thick slots 312 may dictate the orientation of the header 60 on the electrical connector 50. When the header 60 is mounted to the electrical connector the polarization keys 302, 304 and the key slots 310, 312 may ensure that the header 60 may only be inserted into the shroud 52 in a single, predetermined orientation.

Figure 23:
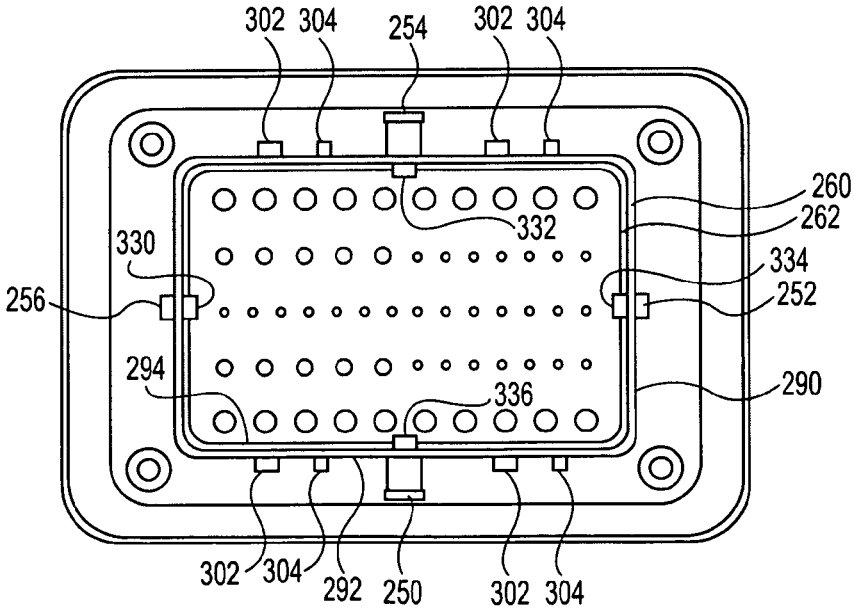
FIG. 23 is a top plan view of the header for use with the electrical connector.
Figure 24:
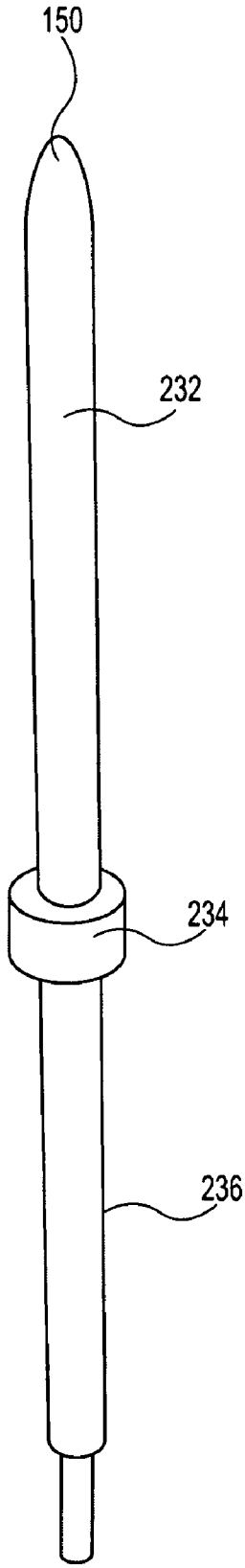
FIG. 24 is a perspective view of an electrical contact of the header.

Referring to FIG. 12, the features of the header 60, the harness connector 54, and the shroud 52 may be configured to ensure that the contacts 90 of the harness connector 54 and the pins 150 of the header 60 engage in a substantially vertical alignment. Accordingly, the harness connector 54 may be substantially perpendicular to the pins 150 during pivoting of the cam arm 58, and resultant movement of the harness connector 54. The electrical connector 50 may thereby prevent the contacts 90 and the pins 150 from breaking, bending, or not aligning as the harness connector 54 engages the header 60. Referring to FIG. 23, the inside surface 294 of the guide wall 290 may include guides 330, 332, 334, 336 that engage guide slots 338, 340, 342, 344 on the front plate 76 of the harness connector, as shown in FIG. 4, as the harness connector 54 enters the guide wall 290. Referring to FIG. 23, the outside surface 292 of the guide wall 290 may also include guides 250, 252, 254, 256 that may engage with guide slots 350, 352, 354, 356 on the inside surface 298 of the shroud, as shown in FIG. 4. The guides 330, 332, 334, 336, 250, 252, 254, 256 and the guide slots 338, 340, 342, 344, 350, 352, 354, 356 of the header 60 and the shroud 52 may help to ensure that the contacts 90 and the pins 150 engage in a substantially straight vertical path. Referring to FIG. 22, the inside surface 294 of the guide wall 290 may include an upper drafted portion 260 and a lower non-drafted vertical portion 262. Referring to FIG. 11, the non-drafted vertical portion 262 may extend above the pins 150 so that the harness connector 54 is guided by the non-drafted portion 260 when the contacts 90 and pins 150 engage. The non-drafted vertical portion 262 may help to ensure that the contacts 90 and the pins 150 engage in a substantially straight vertical path.

Referring to FIG. 2, many of the components of the electrical connector 50 can be assembled before the header is attached to the electrical connector 50. With the harness connector 54 inserted in the shroud 52 and the cam lever 56 in the lower-mid position, the secondary lock 92 may be slid out of an open door in the shroud 52. The contacts 90 with attached wires may be inserted into the apertures 62 through the openings in the back plate 70 until the collars 220 of the contacts 90 pass by the primary locking features 222, as shown in FIG. 10. The wires 204 may be sealed within their respective apertures 62 in the wire grommet 72. The secondary lock 92 may the be slid into a fully inserted position in the harness connector 54 to further secure the contacts 90 in position in their respective apertures 62. Referring to FIG. 2, with the wires in place, the lower portion 142 of the hood 56 may be snapped in place onto the socket body 74. The wires may then be gathered into a wire bundle and laid over the lower portion 142 of the hood 56 at the first opening 136. The upper portion 140 of the hood 56 may then be snapped over the wire bundle onto the lower portion 142 of the hood 56, thereby securing the wire bundle in the first opening 136 of the hood 56. The wire bundle may then be tie-wrapped with the knot facing downward. After the cam lever 58 is pivoted to the first detent, or upper, position, the electrical connector 50 is ready to be attached to the header. The electrical connector 50 may be stored or shipped in this pre-header assembly.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments of this invention are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed:

1. An electrical connector comprising:

a shroud;

a harness connector including at least one aperture, the harness connector being disposed within the shroud;

at least one electrical contact disposed in the at least one aperture; and a cam arm operatively engaged with the harness connector wherein pivoting of the cam arm will move the harness connector with respect to the shroud such that the cam arm may pivot between an upper position wherein the harness connector is fully raised within the shroud and a lower position wherein the harness connector is fully lowered in the shroud.

2. The electrical connector of claim 1 wherein the cam arm includes detents and the shroud includes a detent tab that engages the detents to locate the cam arm at predetermined positions.

3. The electrical connector of claim 1 wherein the harness connector includes a front plate, a socket body, a wire grommet, and a back plate.

4. The electrical connector of claim 1 wherein the contact is a deep drawn contact.

5. The electrical connector of claim 1 wherein the contact is tubular and configured to receive a wire at a first opening at a first distal end and a pin at a second opening at a second distal end to establish an electrical connection between the wire and the pin.

6. The electrical connector of claim 1 further comprising a header, the header including at least one electrical pin in selective communication with the at least one contact.

7. The electrical connector of claim 6 wherein the harness connector includes a plurality of contacts that engage a plurality of respective pins on the header in a predetermined configuration.

8. The electrical connector of claim 6 wherein when the cam arm is in the upper position, the contact and the pin are not in communication and when the cam arm is in the lower position, the contact and the pin are in communication.

9. The electrical connector of claim 1 further comprising a hood, wherein the hood is selectively attached to the top end of the harness connector, the hood including a first opening and a second opening such that a wire may be fed through the first opening and pass through the second opening to establish electrical communication with the at least one contact in the harness connector.

10. The electrical connector of claim 1 wherein the cam arm is reversibly positionable on the electrical connector such that the cam arm may face towards either the front or the rear of the electrical connector.

11. The electrical connector of claim 2 wherein the cam arm includes first, second, third, and fourth detents that correspond to the upper position of the cam arm, the upper-mid position of the cam arm, the lower-mid position of the cam arm, and lower position of the cam arm, respectively.

12. The electrical connector of claim 1 further comprising a primary locking feature to help secure the at least one contact in position within the aperture of the harness connector.

13. The electrical connector of claim 1 further comprising a secondary lock that may be slidably engaged with the electrical connector, the secondary lock being movable between a locked position wherein the secondary lock engages the at least one contact to secure the contact in position within the harness connector, and an unlocked position wherein the secondary lock is not engaged with the at least one contact.

14. The electrical connector of claim 13 wherein the shroud includes a selectively openable door that may be aligned with a slot of the harness connector such that the secondary lock may be slid in and out of the electrical connector when the door and the slot are aligned and the door is open, the secondary lock being secured in the locked position when the door is closed and the secondary lock is in the slot.

15. The electrical connector of claim 1 wherein the header includes a guide wall, wherein when the header is attached to the electrical connector, a portion of the harness connector is disposed within the guide wall such that an outside surface of the harness connector is disposed proximate the inside surface of the guide wall and the shroud is disposed around the guide wall such that an inside surface of the shroud is disposed proximate the outside surface of the guide wall.

16. The electrical connector of claim 15 wherein the guide wall includes a polarization key on the outside surface that correspond to a key slot on the inside surface of the shroud, the polarization key and the key slot ensuring that the header may only be inserted into the shroud in a predetermined orientation.

17. The electrical connector of claim 15 wherein the inside surface of the guide wall includes a guide that engages a guide slot on the harness connector as the harness connector enters the guide wall, the guide and guide slot helping to ensure that the at least one contact and the at least one pin engage in a substantially straight vertical path.

18. The electrical connector of claim 15 wherein the inside surface of the guide wall includes an upper drafted portion and lower non-drafted portion, the non-drafted portion helping to ensure that the at least one contact and the at least one pin engage in a substantially straight vertical path.

* * * * *